US007420119B2

(12) United States Patent
Janos et al.

(10) Patent No.: US 7,420,119 B2
(45) Date of Patent: Sep. 2, 2008

(54) SUBTERRANEAN ELECTRICAL HUB

(75) Inventors: Joseph John Janos, Wadsworth, OH (US); John Joseph Ascherl, Medina, OH (US); Michael William Briggs, Kent, OH (US); Raymond J. Fritz, Northfield, OH (US); Richard Williams, Akron, OH (US)

(73) Assignee: The L.D. Kichler Co., Cleveland, OH (US)

( * ) Notice: Subject to any disclaimer, the term of this patent is extended or adjusted under 35 U.S.C. 154(b) by 57 days.

(21) Appl. No.: 11/564,337

(22) Filed: Nov. 29, 2006

(65) Prior Publication Data

US 2007/0123115 A1 May 31, 2007

Related U.S. Application Data

(60) Provisional application No. 60/741,404, filed on Nov. 30, 2005.

(51) Int. Cl.
*H01H 9/02* (2006.01)

(52) U.S. Cl. ..... 174/53; 174/59; 439/835; 362/146; 324/713

(58) Field of Classification Search ..... 174/53, 174/92, 138 F; 362/146, 183, 410, 431, 358, 362/101, 96; 315/185 R; 439/721, 835, 439/441, 502, 542; 220/3.2, 3.8; 361/641; 324/713

See application file for complete search history.

(56) References Cited

U.S. PATENT DOCUMENTS

| | | | | |
|---|---|---|---|---|
| 6,062,917 | A * | 5/2000 | Kingston | 439/798 |
| 6,612,713 | B1 * | 9/2003 | Kuelbs | 362/102 |
| 6,636,924 | B1 * | 10/2003 | Anderson | 710/305 |
| 6,712,489 | B2 * | 3/2004 | Durkin | 362/358 |
| 7,041,899 | B2 * | 5/2006 | Stekelenburg | 174/50 |
| 7,057,401 | B2 * | 6/2006 | Blades | 324/713 |
| 7,148,419 | B1 * | 12/2006 | Harrigan | 174/53 |

* cited by examiner

*Primary Examiner*—Dhiru R Patel

(74) *Attorney, Agent, or Firm*—Calfee, Halter & Griswold LLP

(57) ABSTRACT

An exemplary subterranean hub for an outdoor system for distributing electrical power to a plurality of fixtures is provided, the hub having a body, a plurality of electrical connectors disposed on the body and adapted to accept mating connectors from a corresponding fixtures, means for electrically coupling an external power source to the electrical connectors, and a depth reference marker, connected to the body and adapted to provide a visual verification that the hub is buried at a sufficient depth during installation of the hub.

22 Claims, 14 Drawing Sheets

SUBTERRANEAN ELECTRICAL HUB

CROSS-REFERENCE TO RELATED APPLICATION

This application claims priority to, and any other benefit of, U.S. Provisional Application Ser. No. 60/741,404, filed on Nov. 30, 2005, and entitled SUBTERRANEAN ELECTRICAL HUB, the disclosure of which is hereby incorporated by reference in its entirety.

TECHNICAL FIELD

The present application relates generally to a hub for electrical fixtures, and more particularly to a subterranean electrical hub, e.g., that may be used for low voltage outdoor lighting.

BACKGROUND

It is known in the art to use outdoor electrical lighting systems using low-voltage lighting fixtures powered by a common transformer. In many outdoor electrical applications, such as outdoor lighting used in residential or commercial landscaping, it is common and perhaps required by various codes to bury the electrical wiring underground.

The installation and maintenance of underground wiring systems can present difficulties. For example, various codes mandate that underground wiring in underground electrical systems be buried at a specific depth. For underground wiring for low-voltage (15-volt) residential landscape lighting installations, recognized safety listing agencies (e.g., National Electric Code) or local codes may require that underground wiring be buried at a specific depth, for example, at least six inches below the surface of the ground. Additionally, underground electrical connections may become difficult to locate and perform maintenance on once they are buried, as indicia of their underground location may degrade over time or become covered, damaged or removed. Known underground systems for connecting transformers to low-voltage lighting fixtures do not adequately address these difficulties.

SUMMARY

According to an inventive aspect of the present application, a device may be provided to facilitate burying electrical wiring at a desired distance below the surface of the ground. In one embodiment, the device may include a hub providing one or more electrical connections, with a depth reference marker provided with the hub. The device may be sized or configured such that the axial or vertical distance between a center-line of at least one of the electrical connections and a reference location on the depth reference marker (for example, a top surface of the depth reference marker) corresponds to a desired depth at which the wiring is to be buried.

In an exemplary embodiment of the present application, a subterranean hub for distributing electrical power to a plurality of outdoor fixtures is provided, the hub having a body, a plurality of electrical connectors disposed on the body, each electrical connector accepting a mating connector from a corresponding fixture, means attached to the body for electrically coupling an external power source to the body to power the plurality of electrical connectors, and a depth reference marker, connected to the body and adapted to provide a visual verification that the hub is buried at a sufficient depth during installation of the hub. Other embodiments may also optionally include any one or more of any of the following: a stake disposed on a lower surface of the body; a depth extension extending upward from an upper surface of the body upon which the depth reference marker is disposed; a location marker for identifying the location of the hub after underground installation; a safety device connected to at least one of the electric connectors, the safety device being adapted to terminate current through the hub at that electrical connector under at least one predetermined condition; a metallic portion permitting the hub to be remotely detectable at a later time when the hub is covered or buried, such as using a metal detector, divining rod, magnetic detector, or the like; and a wiring arrangement enclosed within the hub body for connecting the electrical connectors to the means for electrically coupling the external power source to the hub.

BRIEF DESCRIPTION OF THE DRAWINGS

In the accompanying drawings, which are incorporated in and constitute a part of this specification, embodiments of the invention are illustrated, which, together with a general description given above, and the detailed description given below, serve to exemplify inventive aspects of the present application, wherein.

DETAILED DESCRIPTION

The present application is directed toward systems and methods for distributing power or other electrical signals to outdoor electrical fixtures, such as landscape lighting.

Figure 1:
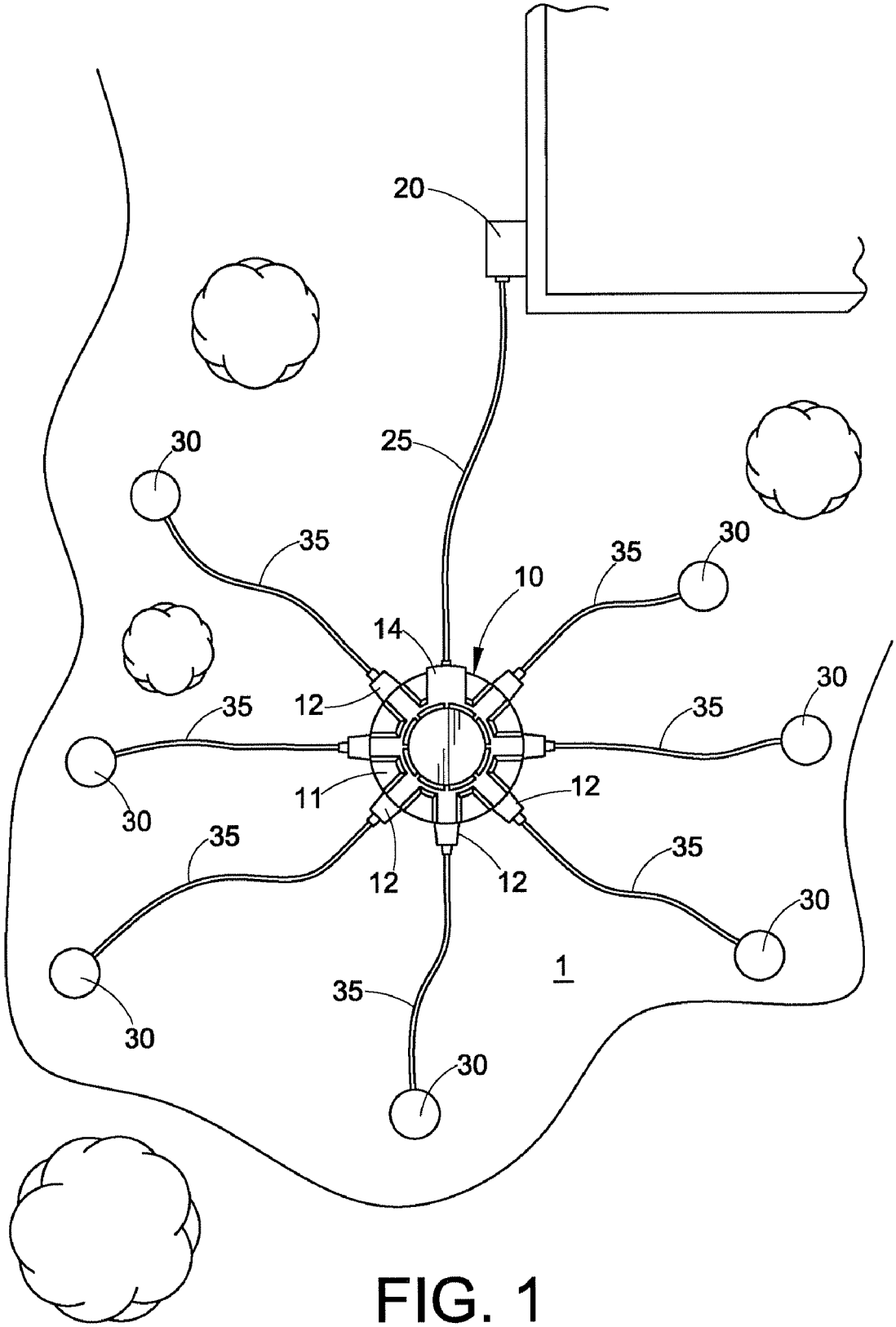
FIG. 1 is a top schematic view of an outdoor electrical system utilizing an exemplary hub, with the hub and wiring, which would normally be buried, shown for clarity.

Referring now to the drawings, FIG. 1 is a schematic drawing showing generally an exemplary embodiment of an outdoor electrical system 1 utilizing a subterranean low voltage hub 10 according to an exemplary embodiment of the present application. The system 1 comprises an external power source 20, such as, for example, a transformer coupled to building wiring (not shown), and a hub 10, providing a plurality of electrical connections 12, to which one or more electrical fixtures 30 may be connected via wiring 35. The fixtures 30 may be any of a number of possible applications, including, for example, lighting fixtures, sound speakers, or security cameras or sensors. The hub 10, along with associated wiring 25, 35, places the plurality of fixtures 30 in circuit communication with the external power source 20. "Circuit communication" as used herein indicates a communicative relationship between devices. Direct electrical, electromagnetic, and optical connections and indirect electrical, electromagnetic, and optical connections are examples of circuit communication. Two devices are in circuit communication if a signal from one is received by the other, regardless of whether the signal is modified by some other device. For example, two devices separated by one or more of the following—amplifiers, filters, transformers, optoisolators, digital or analog buffers, analog integrators, other electronic circuitry, fiber optic transceivers, or even satellites—are in circuit communication if a signal from one is communicated to the other, even though the signal is modified by the intermediate device(s). As another example, an electromagnetic sensor is in circuit communication with a signal if it receives electromagnetic radiation from the signal. As a final example, two devices not directly connected to each other, but both capable of interfacing with a third device, e.g., a CPU, are in circuit communication. Also, as used herein, voltages (also referred to as just "signals") and values representing digitized voltages are considered to be equivalent for the purposes of this application, unless expressly indicated otherwise, and thus the term "voltage" as used herein refers to either a signal, or a value in a processor representing a signal, or a value in a processor determined from a value representing a signal. In exemplary embodiments of hubs disclosed herein, the hub, along with associated wiring, places the plurality of fixtures in direct electrical communication with the external power source.

Electrical power from the external power source 20 may be supplied to the hub 10 through a source cable 25, which couples to the hub 10 for distribution of power to the electrical connections 12. The source cable 25 may be removably coupled to the hub by means of a terminal connection or plug 14 or the like, or in the alternative, the source cable 25 may be permanently affixed to the hub 10. A seal may be provided at the terminal connection 14 by, for example, filling a gap around the terminal connection with a sealant or lubricant, such as a non-hardening silicone grease. As shown in the exemplary embodiment of FIG. 9 and described in more detail below, such a gap may be defined by a trunk line cover 648, which may be assembled to the hub 600 over the terminal connection 640.

As shown in FIG. 1, the electrical connections 12 may be provided around an outer periphery of a hub body 11, allowing for even spacing between connections and minimized entanglement of associated fixture wiring 35. Further, by burying the hub 10 and associated fixture wiring 35 underground, potential hazards to passers-by and risk of damage to the electrical wiring and connections may be minimized.

Figure 2:
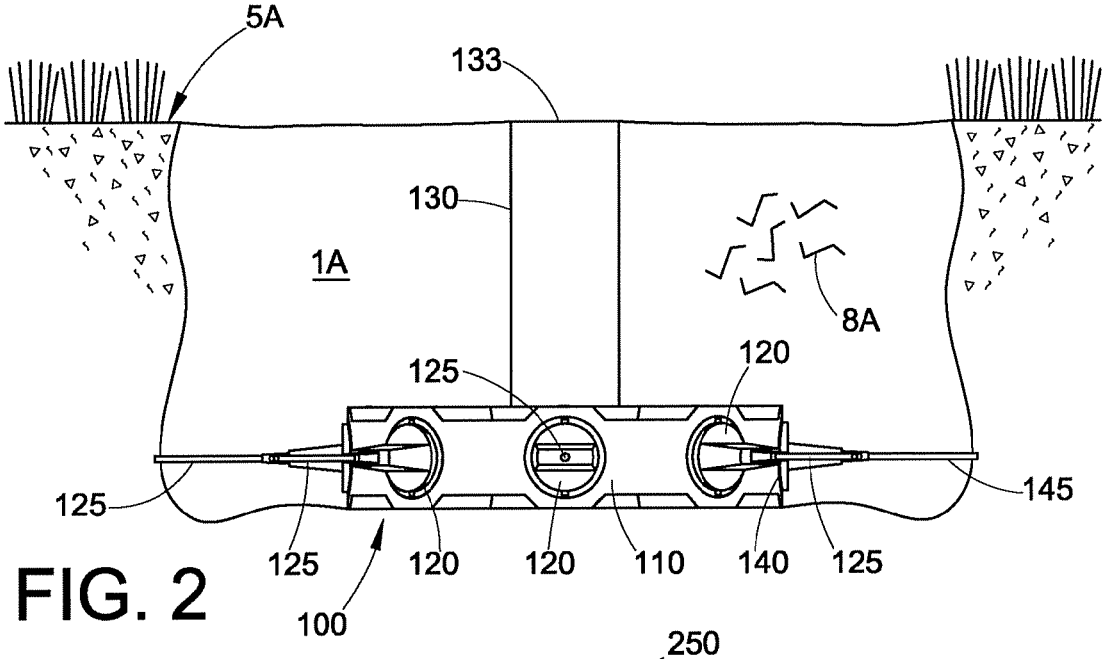
FIGS. 2 and 3 are side elevational views of exemplary hubs, installed in exemplary subterranean applications, with the filling material removed from side surfaces for clarity.

FIG. 2 illustrates a side view of an exemplary hub 100 as installed in a subterranean application. The hub 100 shown has a body 110, a plurality of electrical connections 120 attached to the body 110, and a reference marker 133, in this case the top of a depth extension 130, extending from an upper surface of the hub body 110 that provides a visual verification that the hub is buried at a sufficient depth during installation. One or more fixtures (not shown) may be electrically connected to the electrical connections 120 by means of fixture wiring 125 or any other available means. Additionally, the hub 100 and its electrical connections 120 may be electrically connected to an external power source (not pictured) by means of a source cable 145 coupled to a terminal connection 140 or similar means for attaching to the hub body 110.

When installed in a trench, recess, or other such opening 1A, the depth of the hub body 110, electrical connections 120, and associated fixture wiring 125 may be properly gaged by using reference marker 133, also referred to herein as depth reference marker 133, to position the hub 100 with respect to the ground surface 5A below which the hub 100 is to be buried. The depth reference marker 133 may be provided directly on a cylindrical hub body 110, or, as shown in FIG. 2, may be the upper end of the depth extension 130. In such an exemplary embodiment, by adapting the length of the depth extension 130 to be equal to the minimum depth required for underground wiring, the user can verify that the electrical connections 120 and associated fixture wiring 125 are buried at a sufficient depth by filling the trench or opening 1A with enough dirt or other filling material 8A to cover the depth reference marker 133. In the alternative, the depth reference marker 133 may appear on the length of an extension or may be part of the body 110 of the hub 100 if the body 110 is tall enough.

Figure 3:
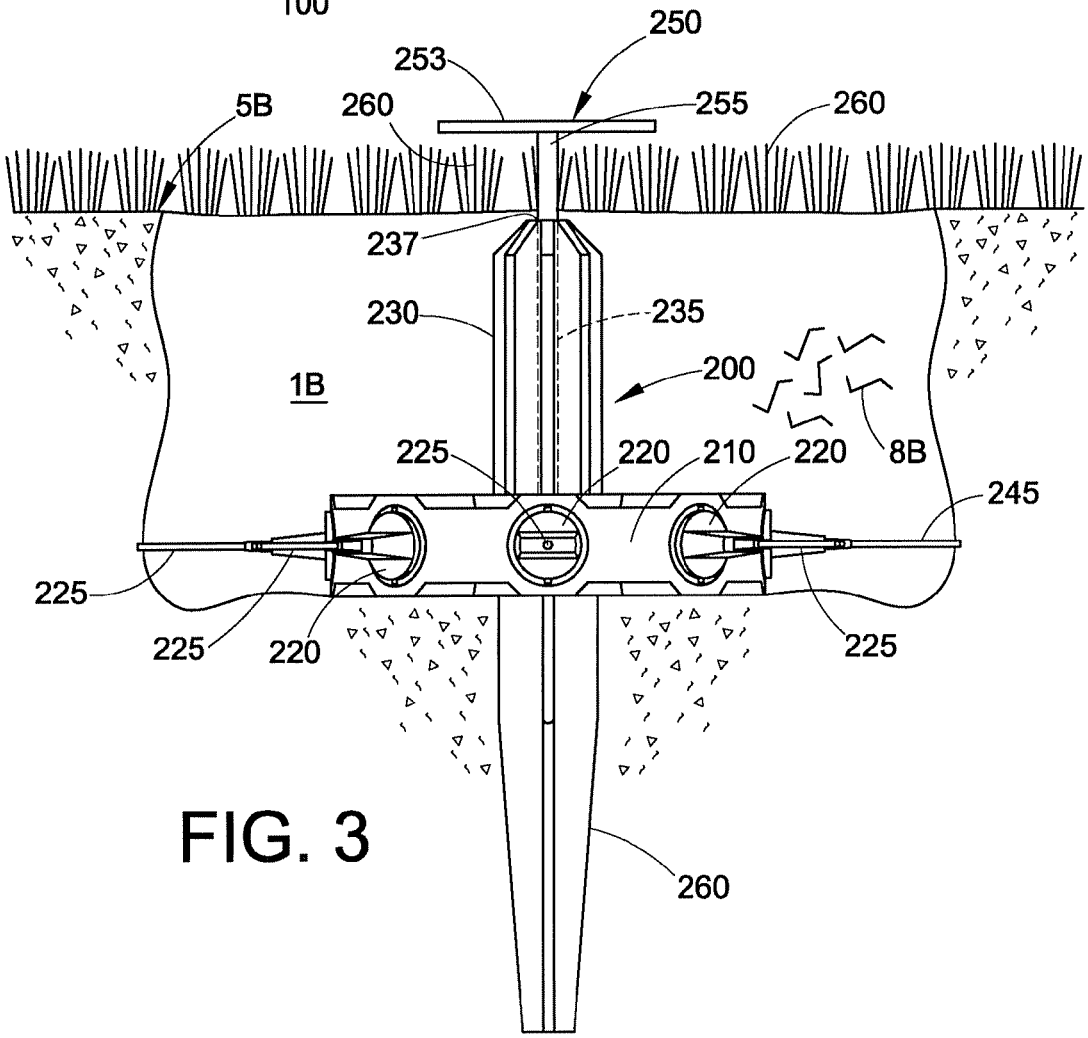

FIG. 3 illustrates a side view of an alternative exemplary embodiment of the hub 200 according to an inventive aspect of the present application, as installed in a subterranean application. In addition to the aspects illustrated in the hub of FIG. 2, the hub 200 also has a location marker 250 connected to the hub body 210. In one embodiment, the location marker 250 may be adjustably attachable to the hub body 210 to provide an above ground visual identifier to assist in locating the hub 200 after it has been installed underground. In the exemplary embodiment shown in FIG. 3, the location marker 250 has a face portion 253 and a stem portion 255. The stem portion 255 is adjustably insertable into a hollow portion 235 of the depth extension 230 (which may have a depth reference marker, e.g., the top of the extension 230). When the hub 200 has been installed, the location marker 250 may be adjusted to extend above the ground surface 5B to be visible above ground. This may be particularly helpful in applications in which covering materials 260, e.g. mulch, grass, and/or additional filling materials are added to the area in which the hub 200 has been buried, allowing the location marker 250 to extend further from the buried hub body 210.

Additionally, an alternative exemplary embodiment may be provided having a portion of the hub 200 constructed of a metallic material (or magnetic material, neither shown in FIG. 3), such that the hub is remotely detectable after being installed underground, such as through the use of a metal detector, divining rod, magnetic detector or other such device. Using such a metallic material for a portion of the location marker 250 (e.g., by providing a metallic piece in the face portion 253 or the stem 255) or the depth extension 230 would place the metallic portion of hub 200 closer to the ground surface 5B, making the location of the hub 200 more easily detectable.

The exemplary hub 200 of FIG. 3 also has an optional stake 260 extending from the lower surface of the hub body 210. During installation, the stake 260 may be used to more firmly plant the hub 200 in the trench or opening 1B, which may facilitate subsequent connections of the fixture wiring 225 and source cable 245 to the electrical connectors 220 of the hub 200. Additionally, when the hub 200 is more firmly planted within the opening 1B, the electrical connections are less likely to become damaged or disconnected due to inadvertent movement of the hub 200 when the opening 1B is filled with filling material 8B.

Figure 4:
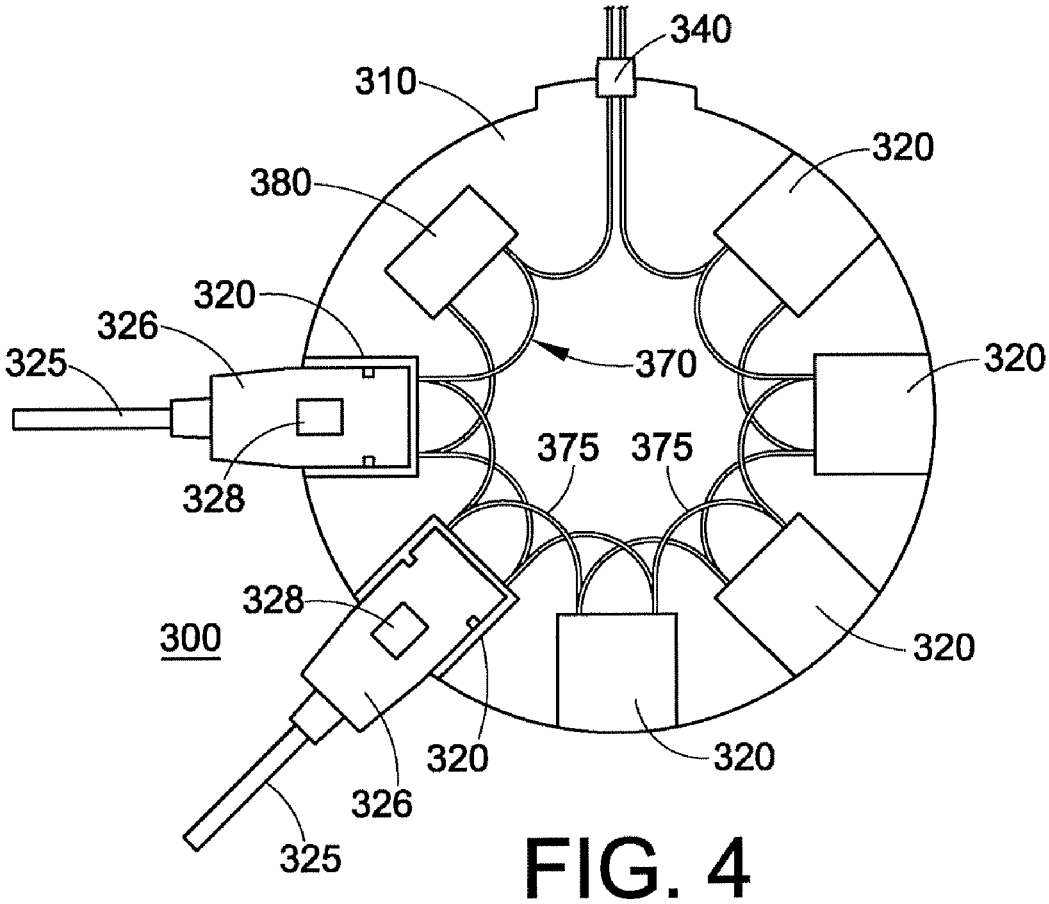
FIG. 4 is a top schematic view of an exemplary hub with a top portion removed to show wiring inside.

FIG. 4 shows a top sectional schematic view of a hub body 310 according to an exemplary embodiment, illustrating an exemplary internal wiring configuration for connection of the electrical connectors 320 to an external power source (not shown). The hub body 310 is shown to enclose a wiring arrangement 370, as known in the art, that provides parallel electrical circuits 375 between each of the electrical connectors 320 and a means disposed on the body 310 for electrically connecting the hub 300 to an external power source, such as a terminal connection represented schematically at 340. The wiring arrangement 370 may include, for example, sections of wire, such as #8 or #10 gage wire, soldered from electrical connector 320 to another electrical connector 320.

Also shown schematically in the embodiment of FIG. 4 is an optional safety device shown schematically at 328 as a safety mechanism, such as a fuse or the like, in plugs 326 or similar connectors. Such a safety mechanism may terminate current through the hub 300 at any or all of the electrical connectors 320 under some predetermined condition, such as excessive temperature, excessive moisture, or overcurrent through any of the electrical connections. Each electrical connector 320 may have an associated safety device 328 of its own. In the example of FIG. 4, the safety devices 328 are shown as being housed in each electrical plug 326 associated with each connector 320 (each of which is shown as a socket in this exemplary embodiment; each connector 320 could be virtually any type of electrical connector). Alternatively, safety devices may be positioned at another location (not shown) along the fixture wiring 325 of each fixture. Additionally, or alternatively, a safety device 380 may be provided in the hub, for example, connected in series with the electrical connectors 320. The safety devices 380 or 328 may be, for example, a positive temperature-sensitive resistor, designed to increase resistance when the local temperature increases, effectively cutting off current through the electrical connectors 320, and to the associated fixtures, when the electrical system is exposed to an overcurrent or other damage (and to automatically or resettably recover from such a condition).

Figure 5:
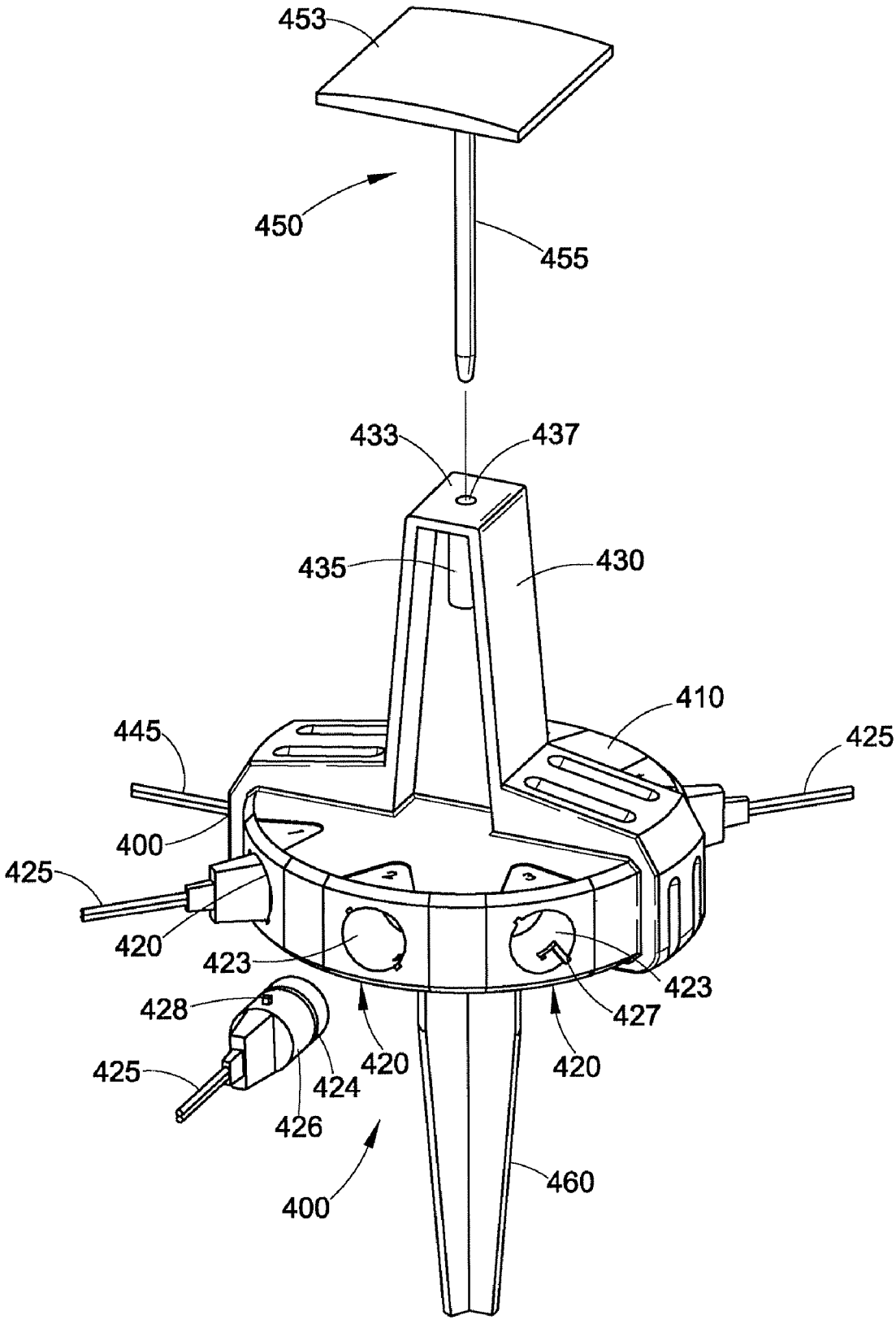
FIGS. 5 and 6 are perspective views of exemplary embodiments of the hub.
Figure 6:
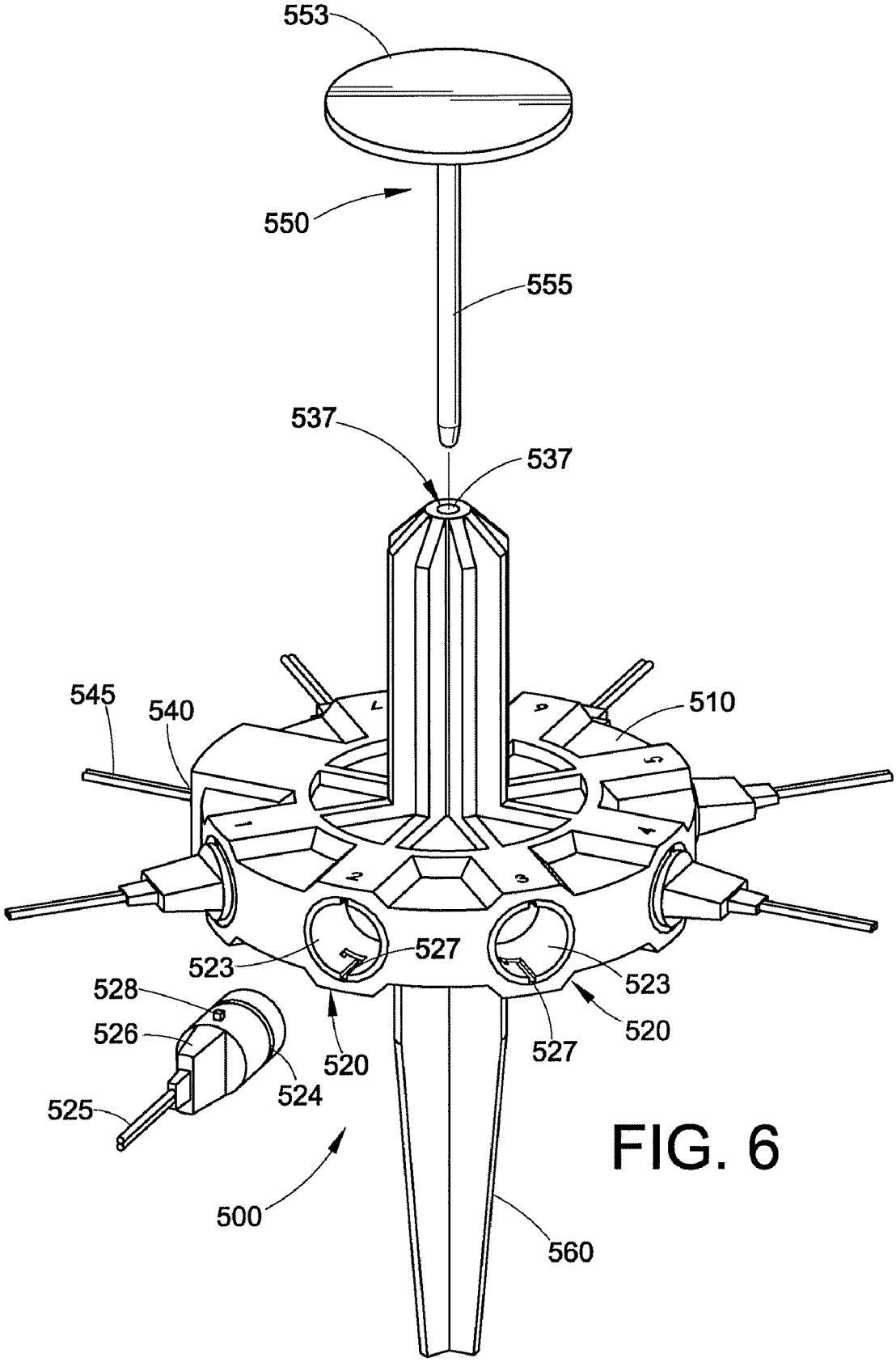

FIGS. 5 and 6 show perspective views of two more exemplary embodiments of electrical hubs. Referring now to FIG. 5, the exemplary hub 400 shown has a body 410, a plurality of electrical connectors 420 disposed on the body 410, and a terminal connection, also disposed on the body 410, to which a source cable 445 connected to an external power source (not shown) may be coupled. The body 410 is approximately cylindrical in shape and has an upper surface, a lower surface, an outer periphery, and a depth extension 430 (the top of which may form a depth reference marker 433), extending from the upper surface. The hub 400 also has a stake 460, extending from the lower surface of the body 410, and a location marker 450, which is adjustably attachable to the hub body 410 (via extension 430) to provide an above ground visual identifier to assist in locating the hub 400 after it has been installed underground.

The exemplary embodiment of FIG. 5 utilizes six electrical connectors 420 positioned around the periphery of the hub body 410. The connectors 420 are provided with sockets 423 utilizing a bayonet-type connection mechanism to lock the associated fixture wiring 425 and plugs 426 into a connected condition. Specifically, each socket 423 is provided with a J-shaped recessed channel 427 along an inner side wall of the socket 423. A corresponding protrusion 428 on the side of the fixture wiring plug 426 aligns with the channel 427 when the plug 426 is connected to the socket 423. The protrusion 428 follows the path of the J-shaped channel 427 when the plug 426 is turned in the socket 423, thereby locking the plug 426 into a connected condition with the socket 423. In an exemplary embodiment, the sockets 423 and plugs 426 may be provided with two opposing J-shaped channels 427 and protrusions 428, respectively, to provide a more secure locked condition for the electrical connection. Further, the hub 400 provides for a water tight connection between each plug 426 and socket 423 through the use of an O-ring seal 424, as one example embodiment of such a water-tight sealing mechanism.

The location marker 450 has a face portion 453 and a stem portion 455. The stem portion 455 is adjustably insertable into a hollow portion 435 through an opening 437 of the depth extension 430. The face portion 453 may be provided in a bright or contrasting color to allow for easy detection of the location marker 450 when it has been installed above ground. Additionally, the location marker 450 may optionally include a metallic portion (not shown), such as a metal clip or washer, to make the location marker 450, and with it, the rest of the hub 400, easily remotely detectable after being installed, for example, through the use of a metal detector, divining rod, magnetic detector, or similar device.

As an example embodiment, the body 410, sockets 423, location marker 450, and stake 460 of the hub 400 of FIG. 5 are constructed from injection molded plastic, e.g., polycarbonate. However, it is contemplated that other means and materials may be used to construct these components, and that the hub components may be combined to form integral components; for example, a hub body 410 with a stake integrally formed on its lower surface. Likewise, the components of the hub 400 may be further divided in additional separate subcomponents; for example, the depth extension 430 may be constructed as a separate component that may be assembled to the upper surface of the hub body 410. If the body 410 of hub 400 is formed from a plurality of parts, some of the joints between those parts may be sealed (e.g., with room temperature vulcanizing (RTV) silicone sealant) to keep moisture out of the hub body 10 and away from the connectors 420.

Referring now to FIG. 6, the exemplary hub 500 shown has a body 510, a plurality of electrical connectors 520 disposed on the body 510, and a terminal connection, also disposed on the body 510, to which a source cable 545 connected to an external power source (not shown) may be coupled. The body 510 is approximately cylindrical in shape and has an upper surface, a lower surface, an outer periphery, and a depth extension 530 (the top of which may form a depth reference marker 533), extending from the upper surface. The hub 500 of the exemplary embodiment of FIG. 6 also has an optional stake 560, extending from the lower surface of the body 510, and a location marker 550, which is adjustably attachable to the hub body 510 (via extension 430) to provide an above ground visual identifier to assist in locating the hub 500 after it has been installed underground.

The exemplary embodiment of FIG. 6 utilizes seven electrical connectors 520 positioned around the periphery of the hub body 510. The connectors 520 are provided with sockets 523 utilizing a bayonet-type connection mechanism 527 to lock the associated fixture wiring 525 and plugs 526 into a connected condition. Specifically, each socket 523 is provided with a J-shaped recessed channel 527 along an inner side wall of the socket. A corresponding protrusion 528 on the side of the fixture wiring plug 526 aligns with the channel 527 when the plug 526 is connected to the socket 523. The protrusion 528 follows the path of the J-shaped channel 527 when the plug 526 is turned in the socket 523, thereby locking the plug 526 into a connected condition with the socket 523.

In an exemplary embodiment, the sockets 523 and plugs 526 may be provided with two opposing J-shaped channels 527 and protrusions 528, respectively, to provide a more secure locked condition for the electrical connection. Further, the hub 500 provides for a water tight connection between each plug 526 and socket 523 through the use of an O-ring seal 524, as one example embodiment of such a water-tight sealing mechanism.

The location marker 550 has a face portion 553 and a stem portion 555. The stem portion 555 is adjustably insertable into a hollow portion 535 through an opening 537 of the depth extension 530. The face portion 553 may be provided in a bright or contrasting color to allow for easy detection of the location marker 550 when it has been installed above ground. Additionally, the location marker 550 may include a metallic portion (not shown), such as a metal clip or washer, to make the location marker 550, and with it, the rest of the hub 500, easily remotely detectable after being installed, such as through the use of a metal detector, divining rod, magnetic detector, or similar device.

As an example embodiment, the body 510, sockets 523, location marker 550, and stake 560 of the hub 500 of FIG. 6 are constructed from injection molded plastic, e.g., polycarbonate. However, it is contemplated that other means and materials may be used to construct these components, and that the hub components may be combined to form integral components; for example, a hub body 510 with a stake integrally formed on its lower surface. Likewise, the components of the hub 500 may be further divided in additional separate subcomponents; for example, the depth extension 530 may be constructed as a separate component that may be assembled to the upper surface of the hub body 510. If the body 510 of hub 500 is formed from a plurality of parts, some of the joints between those parts may be sealed (e.g., with RTV silicone sealant) to keep moisture out of the hub body 510 and away from the connectors 520.

Figure 7:
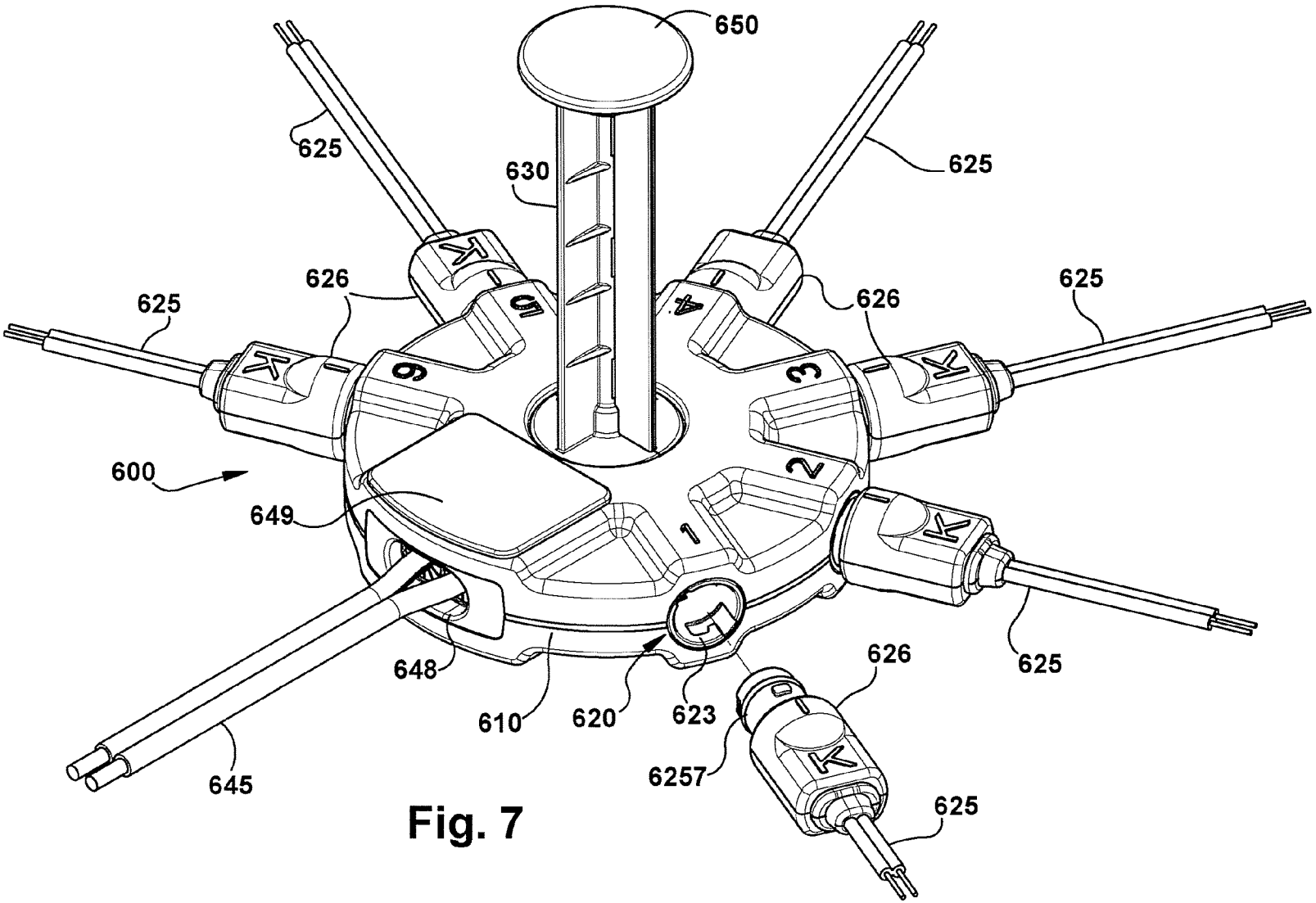
FIG. 7 is an isometric view of an exemplary embodiment of a hub.
Figure 8:
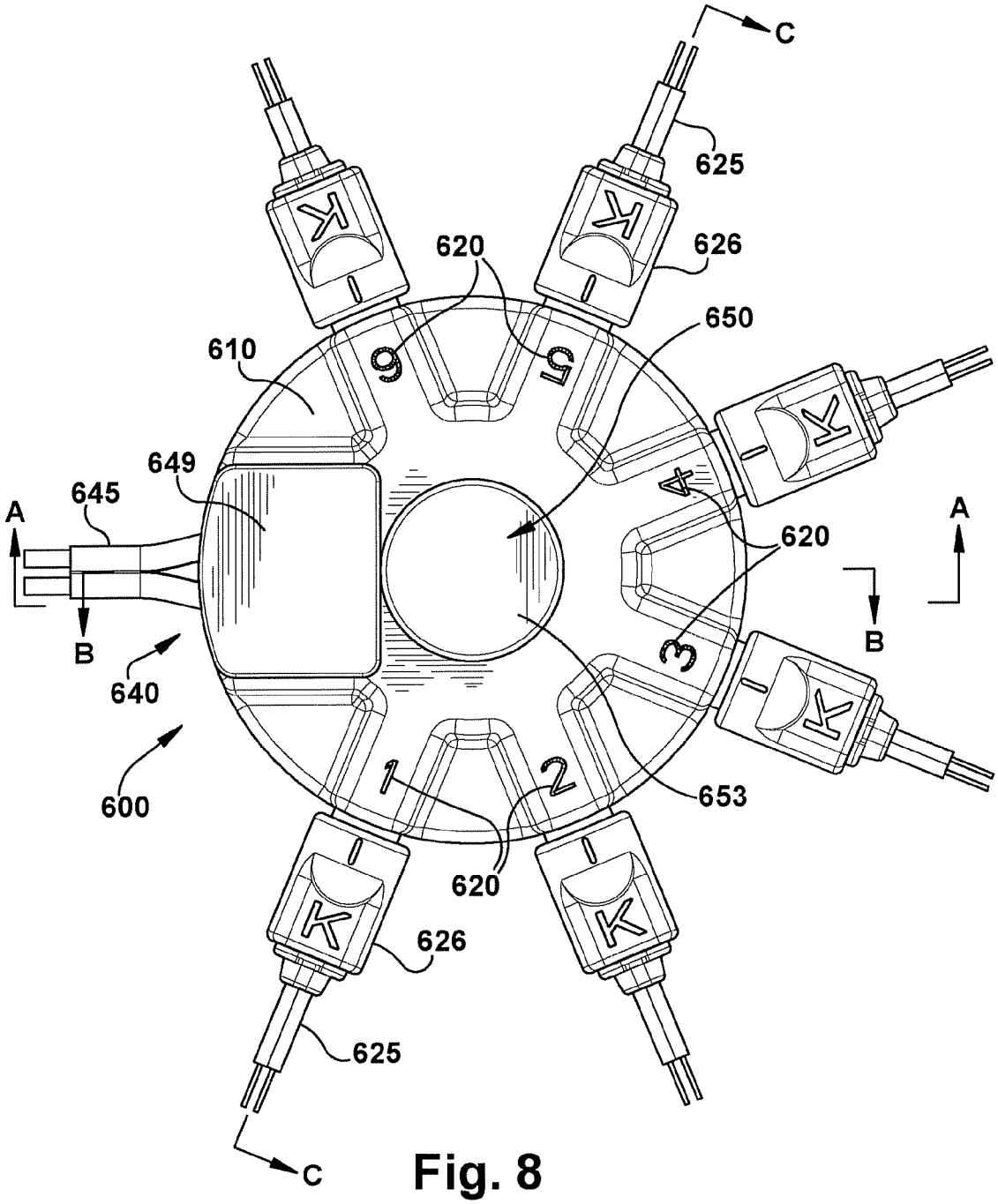
FIG. 8 is a top plan view of the exemplary hub of FIG. 7.
Figure 9:
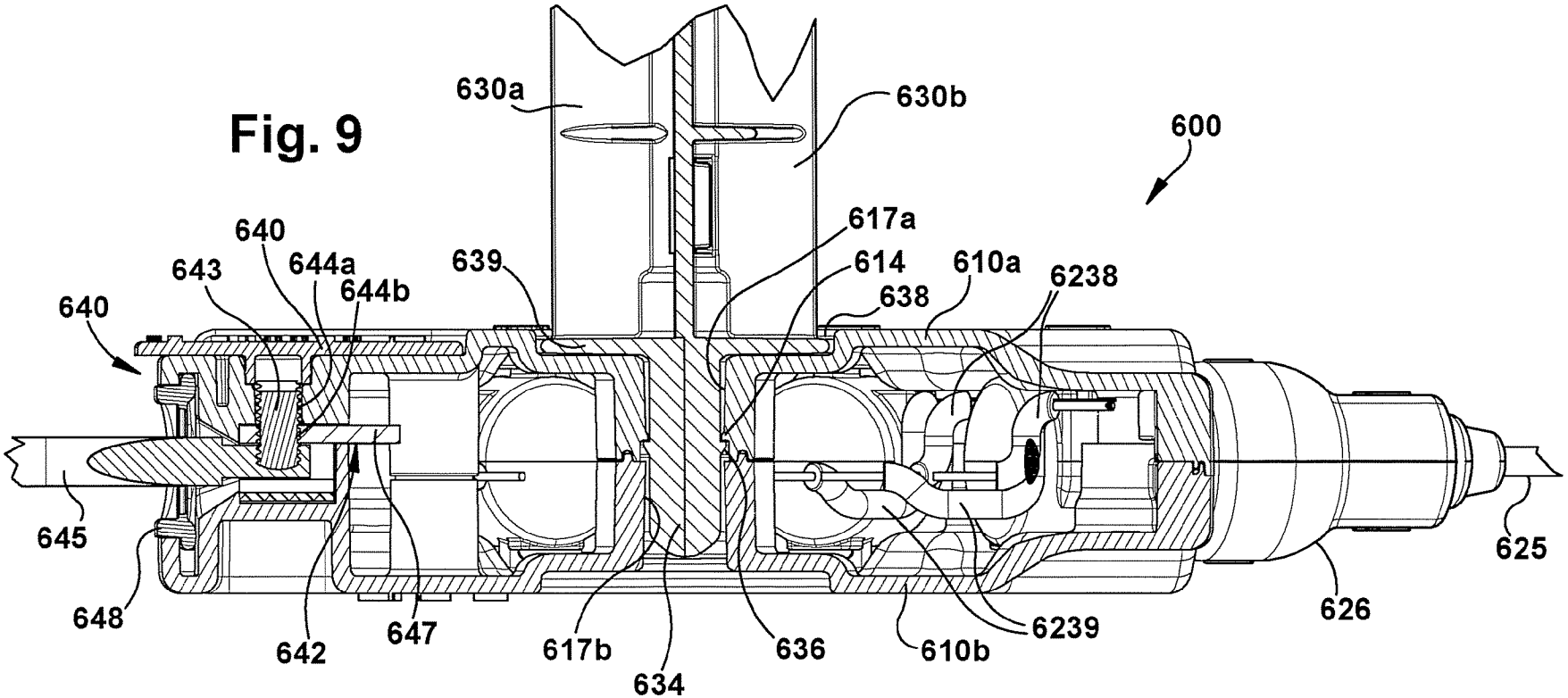
FIG. 9 shows a cross section of the exemplary hub of FIG. 8 through Section A-A.
Figure 10:
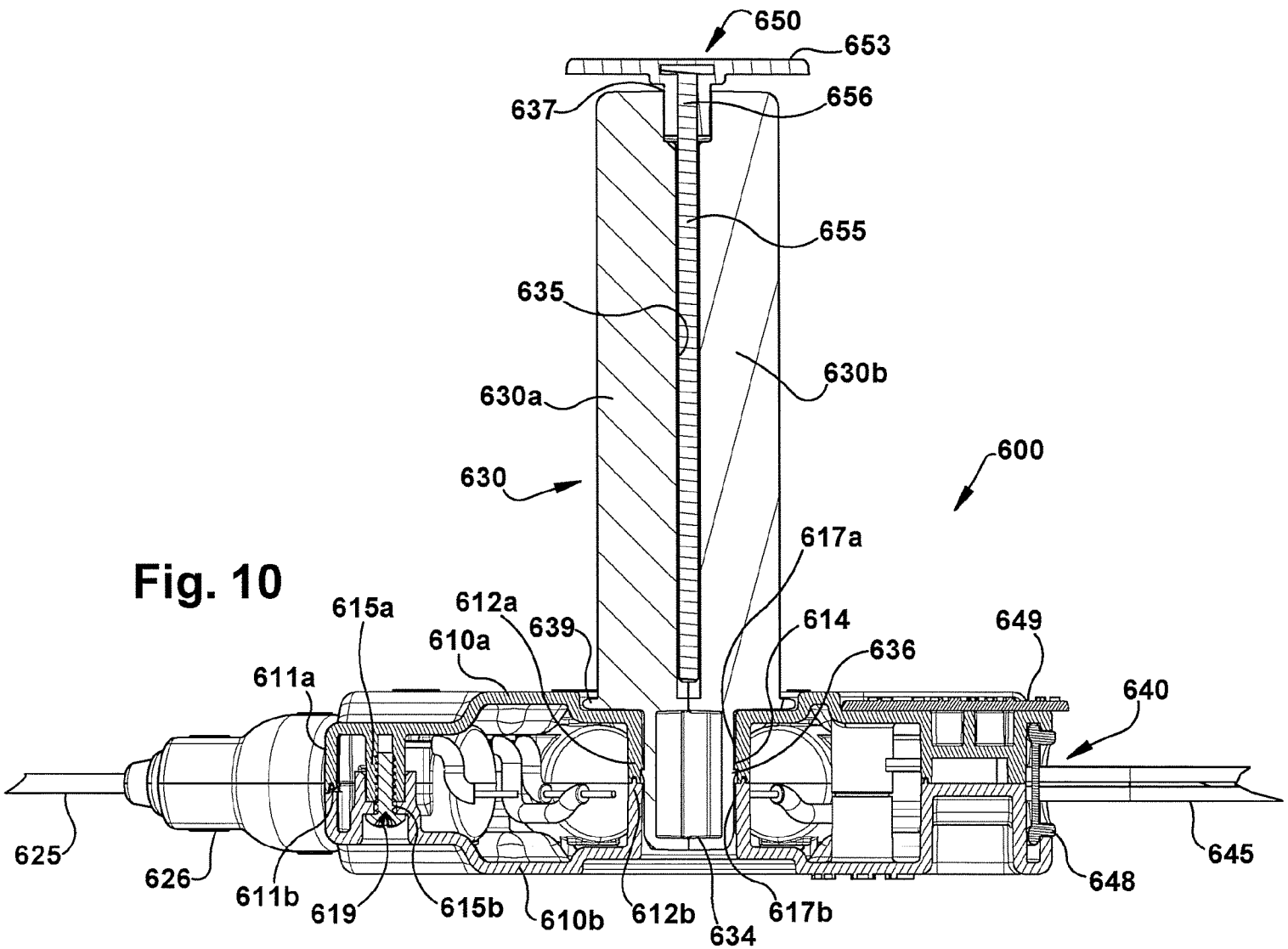
FIG. 10 shows a cross section of the exemplary hub of FIG. 8 through section B-B.
Figure 11:
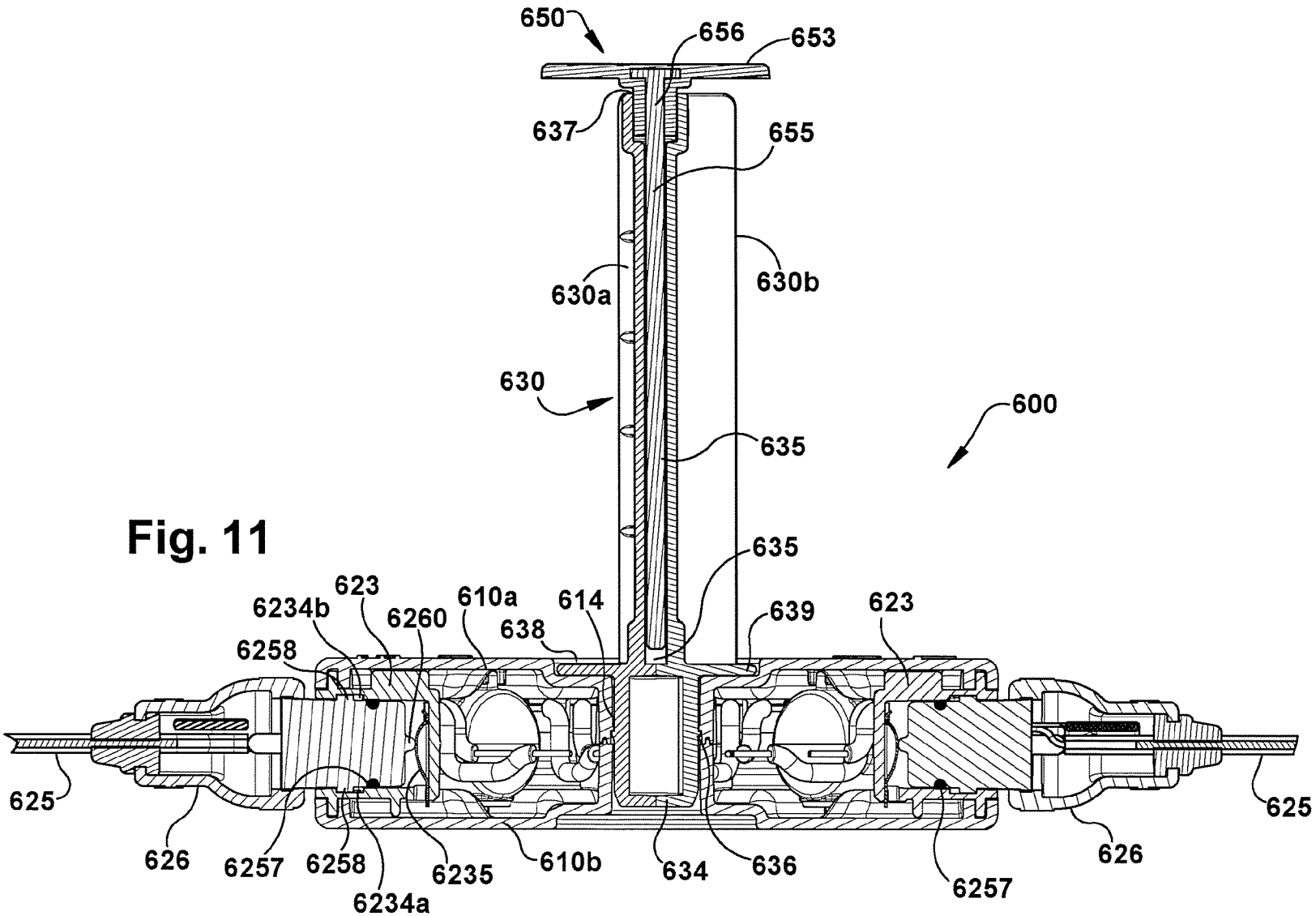
FIG. 11 shows a cross section of the exemplary hub of FIG. 8 through section C-C.

FIGS. 7-14B show another exemplary hub 600. Exemplary hub 600 has six electrical connectors 620 positioned with approximately equal spacing around the periphery of a hub body 610. Of course, a different number of connectors may be used and the connectors 620 need not be equally spaced. Exemplary hub 610 accepts an electrical conductor or source cable 645 from an external power source (e.g., a transformer, not shown) and has a depth extension 630 and a location marker 650. Referring first to FIGS. 7 and 8, the connectors 620 in this example comprise sockets 623, shown in more detail in FIGS. 12, 13A and 13B, for connecting to associated fixture plugs 626 having associated wiring 625 for connection to lighting fixtures (not shown). Further, the hub 600 provides for a water tight connection between each plug 626 and socket 623 through the use of an O-ring seal 6257, as shown in FIG. 11, as one example embodiment of such a water-tight sealing mechanism. The exemplary hub 600 places one or more lighting fixtures into direct electrical connection with the external source of power via wiring 625, 645.

Referring now to FIGS. 10 and 11, the exemplary location marker 650 has a face portion 653 and a stem portion 655. The stem portion 655 is adjustably insertable into a hollow portion 635 through an opening 637 of the depth extension 630. The face portion 653 may be provided in a bright or contrasting color to allow for easy detection of the location marker 650 when it has been installed above ground. Additionally, the exemplary location marker 650 may be formed with the face portion 653 injection molded over a metal nail 656, with the head of the nail 656 embedded in the location marker 653 and a distal portion of the nail 656 forming stem 655. Using metal nail 656 to form part of the location marker 650 permits the location marker 650 (and with it, the rest of the hub 600) to be easily remotely detectable after being installed, such as through the use of a metal detector, divining rod, magnetic detector, or similar device. In the alternative, the entire location marker 650 can be injection molded with optional metallic material (e.g., a metal washer) in a portion of the marker 650.

In this exemplary embodiment, the top of the depth extension 630 extends high enough from the top of the hub body 610 that the wires 625 when connected to the hub are about six inches or at least six inches below the top of the depth extension 630. For example, where the exemplary embodiment of FIGS. 7-14B is provided with a hub body 610 having a height or thickness of 1.5 inches, and the electrical connectors 620 are positioned along a centerline of the hub body, the depth extension 630 would extend about 5.25 inches to provide a reference distance of six inches between the center line of the electrical connections 620 (and wires 625) and the top of the depth extension 630. For applications requiring different burial depths, these dimensions may be modified accordingly. As shown in FIGS. 9-11, the exemplary depth extension 630 of the exemplary embodiment of FIGS. 7-14B is formed from two halves 630*a*, 630*b* that are joined together in a snap-fit arrangement and assembled to the housing body 610. The depth extension halves 630*a*, 630*b* are substantially identical in the exemplary embodiment of FIGS. 7-14B; however, an alternative embodiment may include a depth extension that is asymmetrical or that is composed of geometrically distinct halves. The exemplary depth extension 630 has a stem portion 635 and a base portion 639. The stem portion 635 has a wedge-shaped ridge 636 that is pressed past a shoulder 614 of an internal bore 617*a* in the upper body portion 610*a* during assembly. The base 639 fits into a recess 638 in the upper surface of the upper body portion 610*a*, holding the depth extension 630 rigid in the hub assembly 600.

Figure 12:
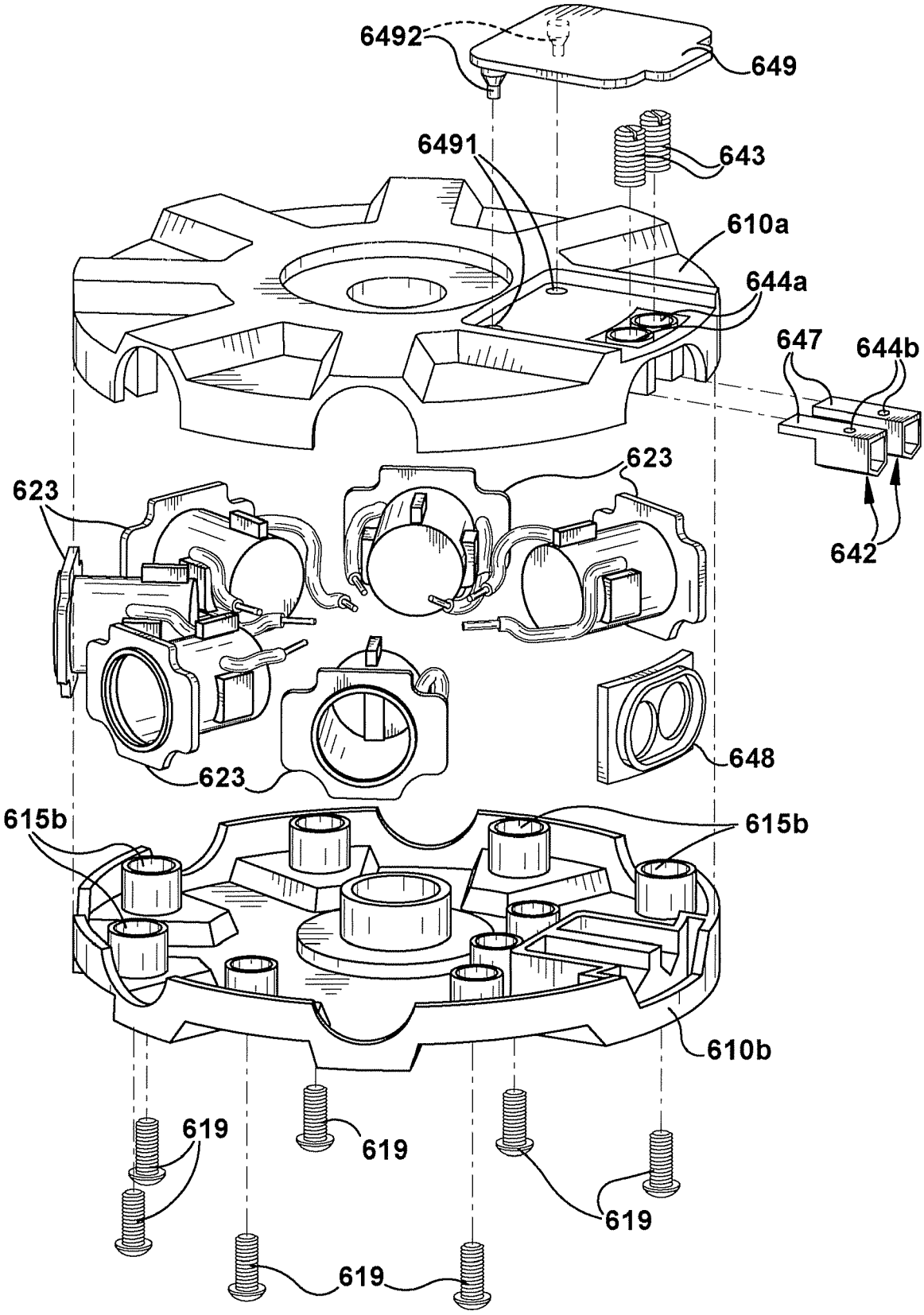
FIG. 12 is an exploded isometric view of an exemplary embodiment of a portion of the exemplary hub of FIG. 8.

As shown in FIGS. 10 and 12, the upper body portion 610*a* of the exemplary embodiment is provided with threaded openings 615*a*, and the lower body portion 610*b* is provided with corresponding, aligned screw holes 615*b*, so that the upper and lower body portions 610*a*, 610*b* may be assembled together using one or more machine screws 619 or other such fasteners. A seal, e.g., RTV sealant, may be used between the portions 610*a*, 610*b*. The exemplary embodiment, as shown in FIG. 10, also employs a snap-fit arrangement between the outer 611*a*, 611*b* and inner periphery walls 612*a*, 612*b* of the upper and lower body portions 610*a*, 610*b*, to provide a seal for the hub body enclosure. Additionally or alternatively, other sealants or gaskets or the like may be used to effect such a seal. A seal between the upper and lower body portions 610*a*, 610*b* at the internal bore 617*a*, 617*b* allows for use of the hub assembly (while maintaining a seal tight enclosure) with the depth extension 630 removed.

In this exemplary embodiment, the source cable 645 is an AWG underground wire connected to the hub 600 at a terminal connection 645. As shown in FIGS. 9 and 12, the terminal connection 640 of the exemplary hub embodiment 600 includes terminal block inserts 642 into which the ends of the source cable 645 are installed. Set screws 643 are threaded through aligned threaded openings 644*a*, 644*b* in the upper body portion 610*a* and the terminal block insert 642 to electrically and mechanically connect each source cable end to a respective terminal block insert 642. The terminal block inserts 642 each have a conductive portion 647 that extends into a central cavity within the hub body 610 of exemplary hub 600. The conductive portions 647 may be sealed at the upper and lower body portions 610*a*, 610*b*, e.g., with silicone grease. The conductive portions 647 are electrically connected to respective wire ends 6238, 6239 (FIGS. 9, 13A, and 13B) of sockets 632 via a wiring arrangement (not shown) enclosed within the hub body 610, and thus electrically connecting the source cable 645 in parallel to the sockets 623. The wiring arrangement may include, for example, sections of wire, such as #8 or #10 gage wire, soldered to the sockets 632. A trunk line cover 648 may be assembled to the hub body 610 around the source cable 645, and provides some protection form dirt and debris for the terminal connection 640. The trunk line cover 648 may be molded from polypropylene, for example, and may have a plurality of slits molded or cut therein to provide a number of flexible, converging approximately triangle-shaped projections to accommodate source cables of different sizes. The trunk line cover 648 may define a gap or pocket near the end of the source cable 645, which may be filled with a sealant or lubricant, such as a non-hardening silicone grease, to provide additional sealing at the terminal connection 640.

The outer periphery of the upper and lower body portions 610*a*, 610*b* of the exemplary embodiment are formed with grooves, recesses, contours and supports, as shown in FIG. 12, to accommodate a flush and snap-fit engagement with the sockets 623, terminal block insert 642, and trunk line cover 648. Further the upper surface of the upper body portion 610*a* of the exemplary embodiment accommodates a screw access cover 649, which covers the openings 644*a* and set screws 643. In this particular exemplary embodiment, the upper surface of the upper body portion 610*a* has openings 6491 that accept and removably retain corresponding projections 6492 of the screw access cover 649 to secure the screw access cover 649 in place as shown in FIG. 7. The screw access cover 649 may be molded from silicone rubber.

Figure 13A:
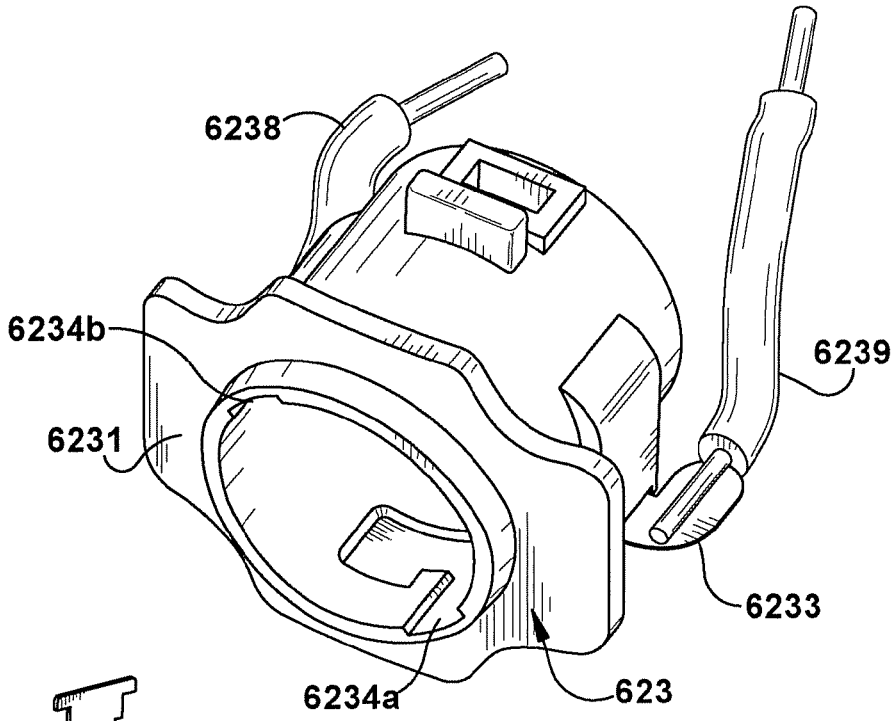
FIGS. 13A and 13B are front/right/top isometric and exploded rear/right/top isometric views, respectively, of exemplary electrical connections shown in FIG. 12.
Figure 13B:
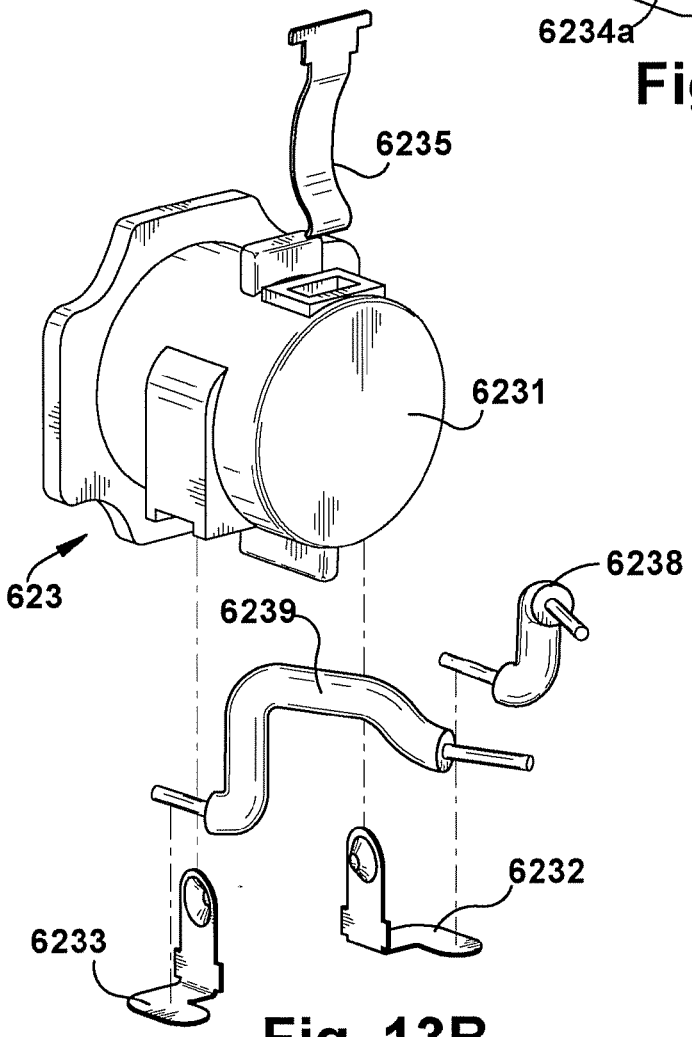

The sockets 623 of the exemplary hub embodiment 600, as shown in FIGS. 13A and 13B, include an injection molded socket body 6231, left and right contacts 6232, 6233, a pair of J-channels 6234*a*, 6234*b*, and a spring 6235. The left and right contacts 6232, 6233 provide electrical connections between the socket 623 and wire ends 6238, 6239 connected to or integral to the hub wiring arrangement (not shown). The J-channels 6234*a*, 6234*b* accept projections 6258 of plugs 626 and cooperate with spring 6235 to form a bayonet-type connection. The spring 6235 within socket 623 engages a projection 6260 of plug 626 (as shown in FIG. 11) to bias the projections 6258 within a retaining portion of J-channel 6234*a*, 6234*b* to retain the plug 626 within the socket 623. In this retained position, contacts 6256 of plug 626 (see FIGS. 14A and 14B) are in electrical contact with contacts 6232, 6233 of socket 623 (see FIGS. 13A and 13B).

As an example embodiment, the hub body portions 610*a*, 610*b*, depth extension halves 630*a*, 630*b*, sockets 623, and location marker 650 of the hub 600 of FIGS. 7-14B are constructed from injection molded plastic, e.g., polycarbonate, as separate components that are assembled together to form the hub assembly 600. However, it is contemplated that other means and materials may be used to construct these components, and that the hub components may be combined to form integral components; for example, a hub body 610 with a depth extension integrally formed on its upper surface. Likewise, the components of the hub 600 may be further divided in additional separate subcomponents; for example, the hub body may comprise a separate center bore portion in addition to upper and lower body portions (not pictured). Or the depth extension may be provided as two identical or geometrically distinct post halves 630*a*, 630*b*, as shown in FIGS. 9 and 10.

Figure 14A:
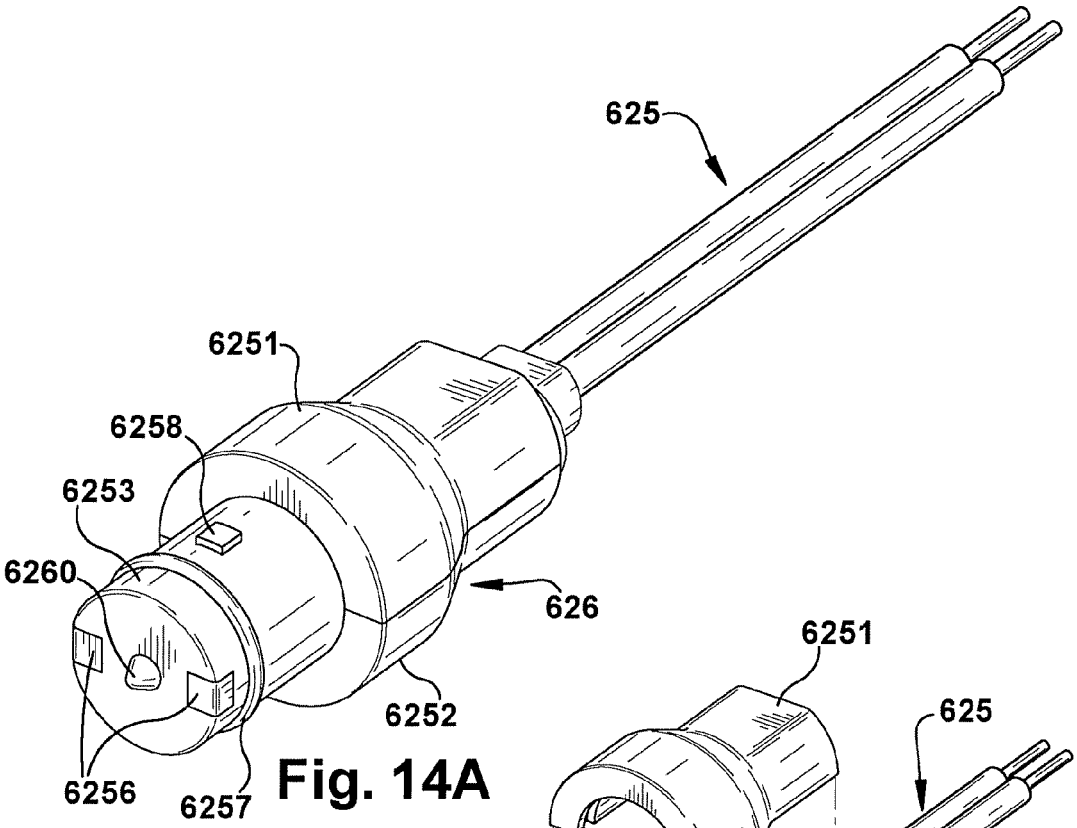
FIGS. 14A and 14B are isometric and exploded isometric views of an exemplary fixture wiring and connector plug that may be used with the exemplary hub of FIG. 8.
Figure 14B:
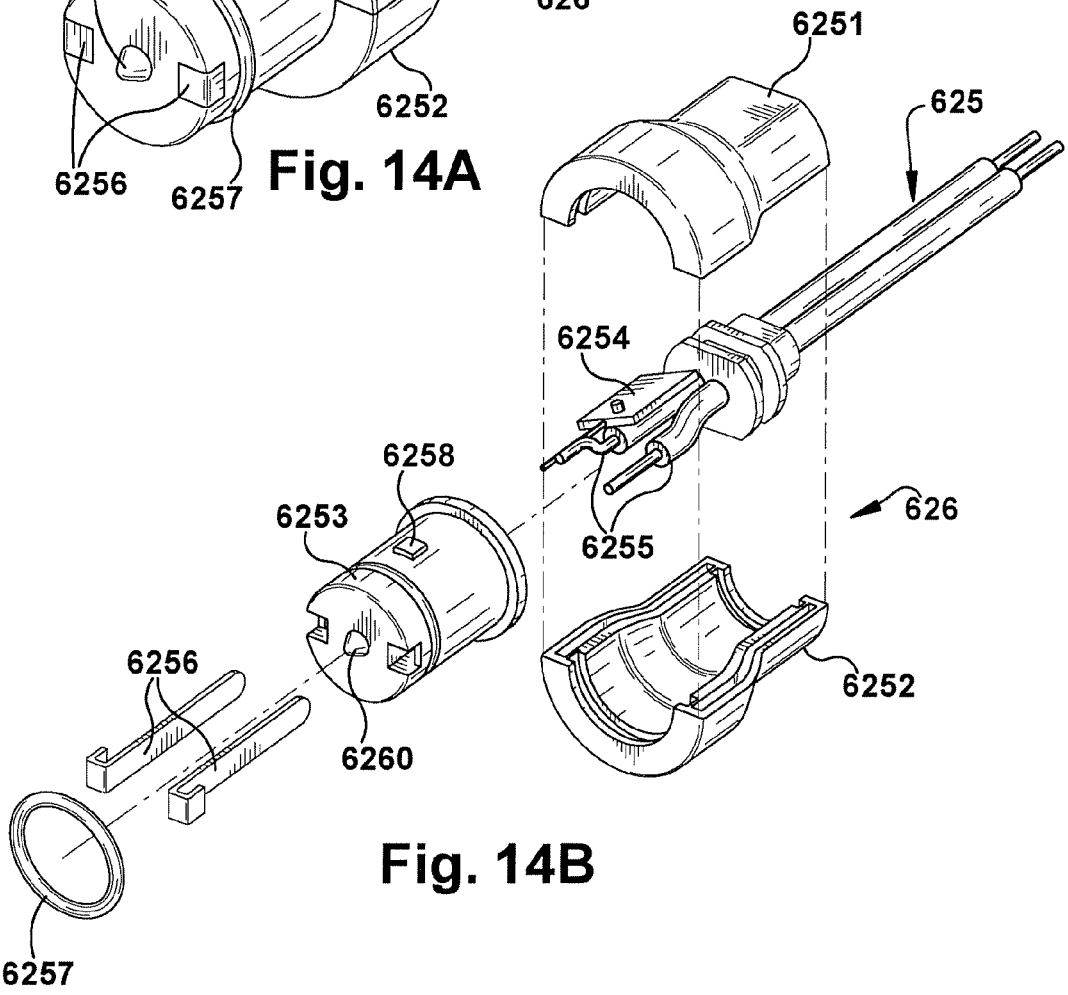

The fixture wiring 625 and plug 626 assembly of the exemplary embodiment, as shown in FIGS. 14A and 14B, include plastic housing halves 6251, 6252 and housing cap 6253, which enclose the electrical switch 6254 and wire ends 6255; a pair of contacts 6256 which extend through corresponding openings in the housing cap 6253; and an O-ring seal 6257, which sits in a groove in the outer diameter of the housing cap 6253. When the plug 626 is installed in a corresponding socket 623, the O-ring seal 6257 creates a water tight seal between the plug 626 and the socket 623.

Figure 15A:
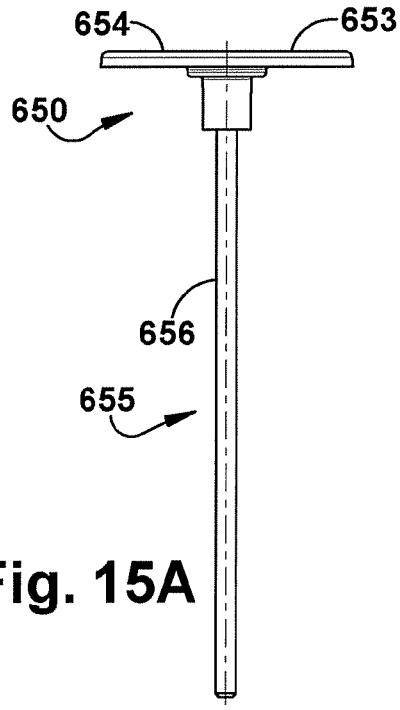
FIGS. 15A and 15B are side elevational and side sectional views of an exemplary location marker that may be used with the exemplary hub of FIG. 8.
Figure 15B:
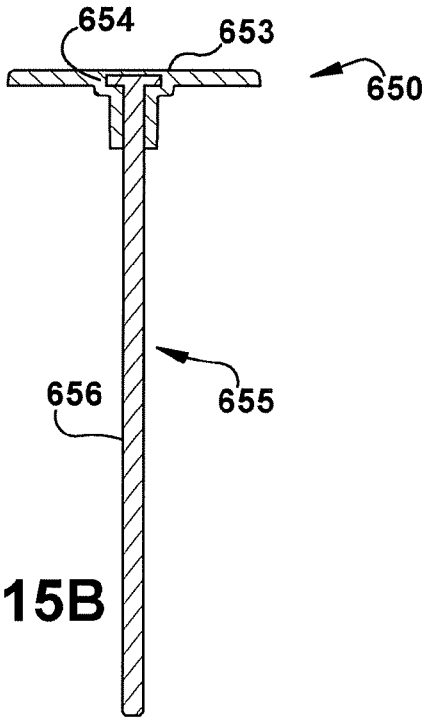

An exemplary location marker 650, as shown in FIGS. 15A and 15B, may comprise a metal nail 656 forming the stem portion 655 of the location marker 650, with a plastic cap 654 molded over the head of the nail 656 to form the face portion 653 of the location marker 650. Such an arrangement allows for easy variability of location marker length (by using different length nails), greater strength and durability of the stem portion 655 (as compared to a thin plastic stem) and easy detection of the stainless steel (or other metal) nail 656 with the use of a metal detector or other such device.

Figure 16A:
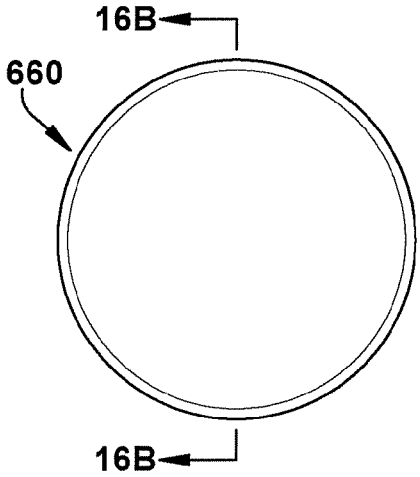
FIGS. 16A, 16B, and 16C front, side cross sectional, and side views of an exemplary embodiment of a hub connection cover that may be used with the exemplary hub of FIG. 8.
Figure 16B:
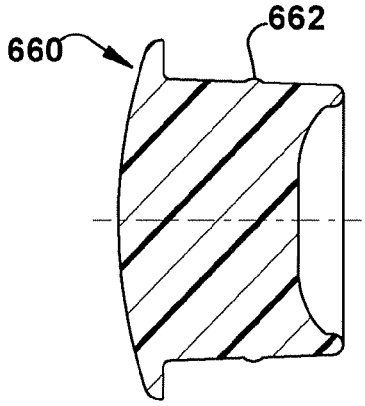
Figure 16C:
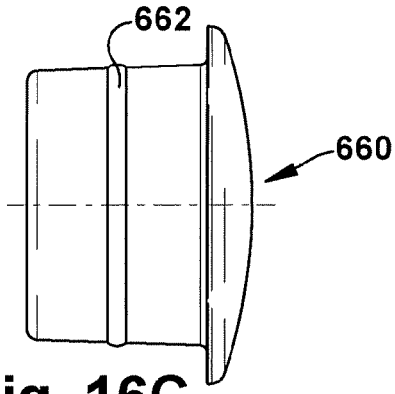

Referring now to FIG. 16, an exemplary embodiment of a hub assembly may additionally include a hub socket cover 660 to cover and protect the internal surfaces of any unused sockets 623, for example, of the hub assembly 600 of FIGS. 7-14B. The cover 660 may be provided with a radial bead 662 around the outer periphery of the cover 660 to provide an interference fit between the cover 660 and the socket 623. Alternatively or additionally, the cover 660 may be provided with an O-ring seal (not shown), similar to O-ring 6257 used with the plug 626 of the exemplary embodiment of FIGS. 7-14, or with any manner of lubricants, sealants, gaskets, or the like, as may provide a seal against moisture, dirt, debris, or other contaminants.

While inventive aspects of the present application have been illustrated by the description of embodiments thereof, and while the embodiments have been described in some detail, it is not the intention of the applicant to restrict or in any way limit the scope of the appended claims to such detail. Additional advantages and modifications will readily appear to those skilled in the art. For example, the teachings herein may be used to connect virtually any type of electrical fixture products, including without limitation outdoor lighting, sound speakers, surveillance cameras, optical sensors, and power outlets, to name a few examples. Further, while the above examples describe a hub for distributing power to a plurality of fixtures, potential embodiments of the invention are not limited to the distribution of power, as it may also be used for the distribution of frequency, telecommunications data, and other electrical signals. Moreover, the steps of the methods described and claimed in the present application may be performed in any suitable order. Therefore, the invention in its broader aspects is not limited to the specific details, representative apparatus and methods, and illustrative examples shown and described. Accordingly, departures may be made from such details without departing from the spirit or scope of the applicant's general inventive concept.

We claim:

1. A subterranean hub for distributing electrical power to a plurality of outdoor fixtures, the hub comprising:

a body;

a plurality of electrical connectors disposed on the body, each electrical connector accepting a mating connector from a corresponding fixture;

means attached to the body for electrically coupling an external power source to the inside of the body to power the plurality of electrical connectors; and a depth extension extending upward from the body, and upon which a depth reference marker is disposed, the depth reference marker adapted to provide a visual verification that the hub is buried at a sufficient depth during installation of the hub.

2. The hub of claim 1, further comprising a stake disposed on a lower surface of the body.

3. The hub of claim 1, wherein the depth reference marker comprises an upper end of the depth extension.

4. The hub of claim 1, wherein a portion of the depth extension is metallic so the hub is detectable with a metal detector when buried.

5. The hub of claim 1, further comprising a location marker adapted to be assembled with the body for identifying the location of the hub after the hub has been installed underground.

6. The hub of claim 5, wherein the location marker comprises a stem, the stem being adjustably insertable into a hollow portion of the depth extension to adjustably position the location marker relative to the depth extension.

7. The hub of claim 6, wherein a portion of the location marker is metallic so the hub is detectable with a metal detector when buried.

8. The hub of claim 1, wherein a portion of the hub is metallic and adapted to be positioned so the hub is detectable with a metal detector when buried.

9. The hub of claim 1, wherein the electrical connectors are adapted to provide water resistant connections.

10. The hub of claim 1, wherein the electrical connectors are bayonet-type connectors.

11. The hub of claim 1, wherein the hub further comprises a safety device connected to at least one of the electrical connectors, the safety device being adapted to terminate current through the hub at that electrical connector under at least one predetermined condition.

12. The hub of claim 11, wherein the safety device is connected in series electrical relationship with each electrical connector.

13. The hub of claim 11, wherein the safety device terminates current when a temperature of the safety device exceeds a predetermined value.

14. The hub of claim 11, wherein the safety device is a positive temperature sensitive resistor.

15. The hub of claim 1, further comprising a wiring arrangement enclosed within the hub body, the wiring arrangement comprising wires connecting the electrical connectors to the means for electrically coupling an external power source to the inside of the body.

16. The hub of claim 1, wherein each electrical connector comprises a socket adapted to receive a plug.

17. The hub of claim 1, wherein the depth extension is integrally formed with the body.

18. The hub of claim 1:

wherein the depth reference marker comprises an upper end of the depth extension;

further comprising a stake disposed on a lower surface of the body;

further comprising a location marker adapted to be assembled with the body for identifying the location of the hub after the hub has been installed underground;

wherein the location marker comprises a stem, the stem being adjustably insertable into a hollow portion of the depth extension to adjustably position the location marker relative to the depth extension;

wherein a portion of the location marker is metallic so the hub is detectable with a metal detector when buried;

wherein the electrical connectors are adapted to provide water resistant connections and are bayonet-type connectors; and wherein the hub further comprises a safety device connected to at least one of the electrical connectors, the safety device being adapted to terminate current through the hub at that electrical connector under at least one predetermined condition.

19. A method for installing an outdoor system for distributing electrical power to a plurality of fixtures, the method comprising the steps of:

providing a hub, the hub comprising a body with a depth extension having a depth reference marker and extending upward from an upper surface of the body, a plurality of electrical connectors, and a means for electrically coupling an external power source to the inside of the body to power the plurality of electrical connectors;

providing a subterranean opening in an area in which the system is to be installed, the recess being deep enough that connectors on the hub are positioned at a sufficient subterranean depth;

positioning the hub within the recess so that the depth reference marker on the depth extension is at least at a predetermined depth in the subterranean opening;

connecting the means for electrically coupling an external power source to the inside of the body to the external power source;

connecting at least one fixture to one of the electrical connectors; and covering the hub by depositing a filling material in the opening.

20. The method of claim 19, further comprising the step of marking the location of the hub with a location marker affixed to at least one of the hub body and the hub depth extension.

21. A subterranean hub for an outdoor system for distributing electrical power to a plurality of lighting fixtures, the hub comprising:

a cylindrical body having an upper surface, a lower surface, an outer periphery, and a depth extension extending upward from a center portion of the upper surface, the depth extension having an upper end which provides a depth reference marker, the depth reference marker providing a visual verification that the hub is buried at a sufficient depth during installation of the hub;

a plurality of electrical connectors, attached to the outer periphery of the body and approximately equally spaced around the outer periphery of the body, each electrical connector being adapted to accept a mating connector from a corresponding fixture;

a terminal connection, attached to the body and in circuit communication with the plurality of electrical connectors and adapted to accept a source cable for connection to an external power source; and a location marker comprising a stem portion adapted to be adjustably insertable into a hollow portion of the depth extension, a face portion adapted to be visually identifiable above ground after installation of the hub, and a metallic portion adapted to be detectable with a metal detector when covered.

22. The hub of claim 21, further comprising a stake, extending downward from a center portion of the lower surface of the body.

* * * * *